United States Patent [19]

Brocklehurst

[11] Patent Number: 4,735,161

[45] Date of Patent: Apr. 5, 1988

[54] SEWING MACHINE THREAD BREAKAGE DETECTOR

[75] Inventor: Charles E. Brocklehurst, Fountain Inn, S.C.

[73] Assignee: Sew Simple Systems, Inc., Fountain Inn, S.C.

[21] Appl. No.: 920,657

[22] Filed: Oct. 20, 1986

[51] Int. Cl.[4] ..... D05B 69/36

[52] U.S. Cl. ..... 112/273; 200/61.18

[58] Field of Search ..... 112/278, 254, 273, 302, 112/247, 275; 242/36, 37 R; 200/61.18, 161, 163; 66/161, 163

[56] References Cited

U.S. PATENT DOCUMENTS

| | | | |
|---|---|---|---|
| 2,251,368 | 8/1941 | Moser . | |
| 2,534,999 | 12/1950 | Stevens | 28/64 |
| 2,667,134 | 1/1954 | Jeckert . | |
| 2,921,546 | 1/1960 | Vossen . | |
| 3,029,763 | 4/1962 | Turner et al. | 112/273 |
| 3,159,123 | 12/1964 | Godwin et al. . | |
| 3,587,497 | 6/1971 | Beazley . | |
| 3,891,812 | 6/1975 | Marforio | 200/61.18 |
| 4,186,672 | 2/1980 | Burton | 112/273 |
| 4,269,131 | 5/1981 | Principe | 112/273 |
| 4,271,763 | 6/1981 | Berger | 200/61.18 X |
| 4,292,868 | 10/1981 | Werffeli | 242/36 X |
| 4,372,235 | 2/1983 | Principe | 112/273 |
| 4,410,803 | 10/1983 | Henze | 250/561 |
| 4,570,560 | 2/1986 | Hubele | 112/273 |

*Primary Examiner*—Andrew M. Falik
*Attorney, Agent, or Firm*—Thomas & Kennedy

[57] ABSTRACT

In a sewing machine a thread 20 moves through a check spring 30, through a takeup arm 32, and to a needle 15. During normal operation, a proximity detector 55 detects the movement of a flag 50 attached to a loop 36 of the check spring during each movement of the takeup arm 32. The proximity detector is supported in a position adjacent the path of movement of the flag. When the thread breaks at the needle, tension is no longer applied to the thread by takeuparm 32, so that check spring 36 and its flag 50 no longer move in front of the detector 55, causing a control circuit to deactivate the sewing machine motor.

11 Claims, 2 Drawing Sheets

SEWING MACHINE THREAD BREAKAGE DETECTOR

FIELD OF INVENTION

This invention relates to a thread breakage monitor or a "stop motion" device for the needle thread of a sewing machine, which terminates the operation of the sewing machine in response to the breakage of the needle thread.

BACKGROUND OF THE INVENTION

When sewing machines are operated on a continuous basis at high speed for forming the hems of sheets and similar long run applications, it is highly desirable to immediately detect any breakage or depletion of thread in the system. Otherwise, the system will continue to operate without thread extending to the needle and the work product will be improperly formed. It is difficult and time consuming to reposition the work product in the proper folded configuration at the sewing machine needle if the work product has continued to move some distance after the breakage of thread.

Several stop motion systems have been developed in the past to detect the breakage of the needle thread and to terminate the operation of the sewing machine motor in response to such detection. For example, U.S. Pat. Nos. 3,587,497, and 4,186,672 disclose stop motion systems.

One of the prior art stop motion systems used for the detection of needle thread breakage operates by permitting the check spring that is reciprocated in response to varying thread tension to make electrical contact with a contact block when the thread is relaxed. Because the check spring is moved on each cycle of the sewing needle as the thread is tightened and then relaxed by the takeup arm, the circuit to the contact block made by the check spring is opened during each cycle. Thus, by detecting the opening and closing of the circuit made between the check spring and its contact block, a continuing signal is provided as long as the needle thread is properly fed to the sewing needle and is stitched into the work product.

One of the problems of the above-noted check spring and contact block arrangement is that over prolonged use the lint, dust and oil in the normal environment of the sewing machine accumulates at and around the contact block and/or check spring and increases the electrical resistance between these elements, so that a proper signal might not be generated in response to the movement or the absence of movement of the needle thread in the sewing machine. Further, there are times when the needle thread breaks at the needle but the thread continues to move, not through the needle but through the presser foot with the thread being carried by the work product in the sewing direction, which tends to pull the thread continuously with the work product. This is likely to cause the check spring to continue to oscillate against its contact block in response to the reciprocation of the takeup arm and generate the same signal as when the thread is not broken and is properly moving through the eye of the sewing needle, so that the detector system does not properly function to detect the broken thread.

SUMMARY OF THE INVENTION

Briefly described, the present invention comprises a sewing machine having a thread breakage monitor that functions to detect the proper movement of the needle thread through the check spring and takeup arm toward the eye of the sewing needle in spite of any build up of oil, lint and debris at or around the check spring. Further, the invention comprises a means for detecting an instantaneous lapse in the movement of the check spring of the sewing machine when there is breakage of the thread but the thread continues to move with the work product. The short duration when the thread breaks and before the thread begins to move with the work product results in the check spring missing one or a few cycles of movement, which is detected, and operation of the sewing machine is terminated.

The looped end portion of the check spring of the sewing machine has an added layer of metal attached thereto which functions as a "flag" so that the flag moves with the looped end of the check spring back and forth from a position of rest through an arcuate path. A proximity detector is placed adjacent the arcuate path so as to detect the movement of the flag when tension is applied to the needle thread and the check spring moves against its bias away from its rest position. Should the flag terminate its movement because of the breakage of the needle thread, or should the movement of the flag be interrupted, a control circuit responds to terminate the operation of the sewing machine motor.

Thus, it is an object of this invention to provide a sewing machine with an improved thread breakage monitor that functions reliably to detect improper movement of the needle thread to the needle of the sewing machine and to terminate the operation of the motor of the sewing machine.

Another object of this invention is to provide a check spring and proximity detector for the needle thread of a sewing machine, with the proximity detector arranged to detect the motion of the check spring during operation of the sewing machine, so that the operation of the sewing machine can be interrupted in response to the absence of movement of the check spring.

Another object of this invention is to provide a sewing machine that includes an improved stop motion system for the needle thread of the sewing machine, which is more reliable than the prior art systems, and which is inexpensive to construct and to maintain.

Other objects, features and advantages of this invention will become apparent upon reading the following specification, when taken in conjunction with the accompanying drawings.

DETAILED DESCRIPTION

Figure 1:
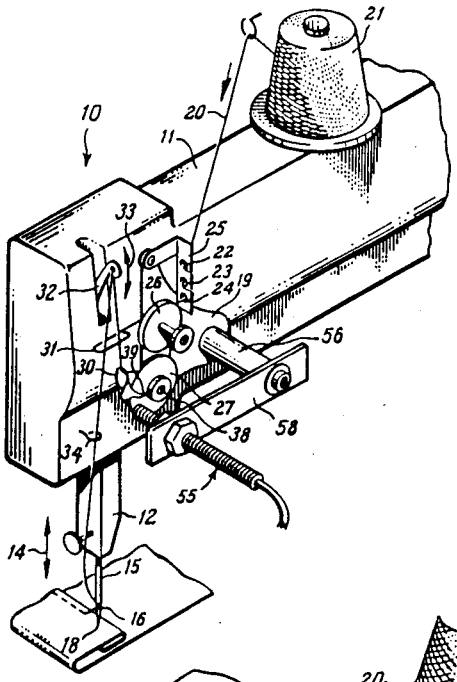
FIG. 1 is a partial perspective illustration of the head portion of a sewing machine, showing the sewing needle and the manner in which the needle thread moves from a supply to the sewing needle.

Referring now in more detail to the drawings, in which like numerals indicate like parts throughout the several views, FIG. 1 illustrates a sewing machine 10 which includes a housing 11 that forms the head of the sewing machine, with a needle holder 12 that protrudes downwardly from the housing 11 and which reciprocates as shown by double arrow 14. Sewing needle 15 is mounted over a work product in needle holder 12 with the eye 16 being located just upwardly of the needle point 18. The presser foot and other components are not illustrated, but it will be understood by those skilled in the art that other conventional components will be used in combination with those illustrated components during the normal sewing function.

The needle thread 20 is pulled from a supply such as cone 21, with the needle thread 20 moving along its length first through the openings 22, 23 and 24 of thread guide 25, then to thread tensioner 26, then about check spring tensioner 27, through the looped end of check spring 30, through thread guide 31 to thread takeup arm 32, then back through thread guide 31, through lower guide 34, and finally through the eye 16 of needle 15. The thread guide 25, thread tensioners 26 and 27 and their related components are all mounted to support plate 19 which is mounted to the sewing machine housing 11.

Figure 2:
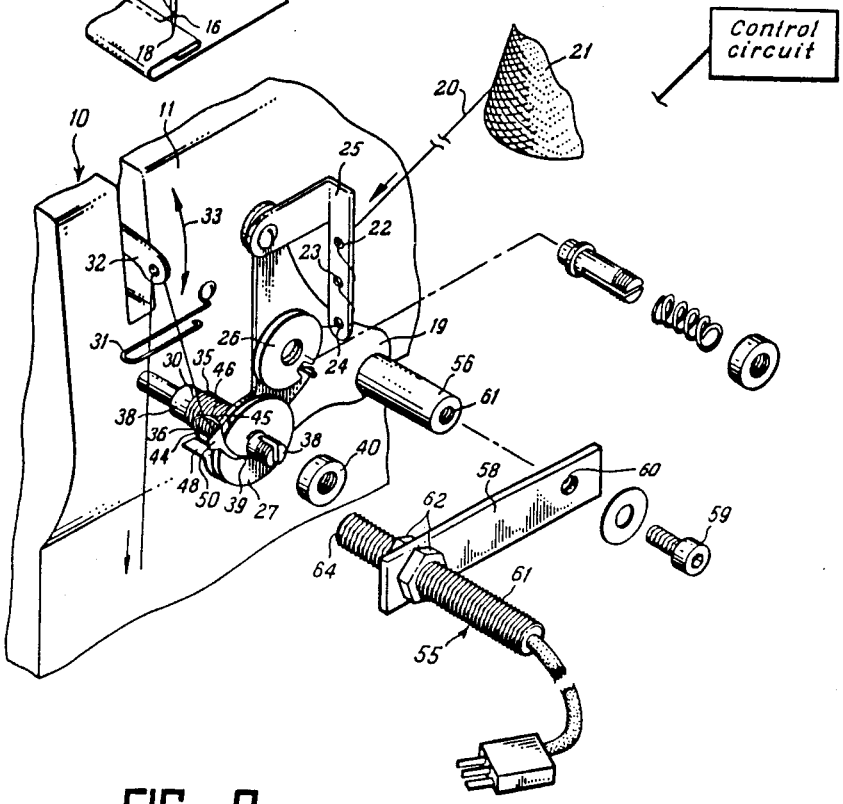
FIG. 2 is an exploded perspective view of the check spring, spring tensioners, takeup arm and related components of the sewing machine of FIG. 1.
Figure 3:
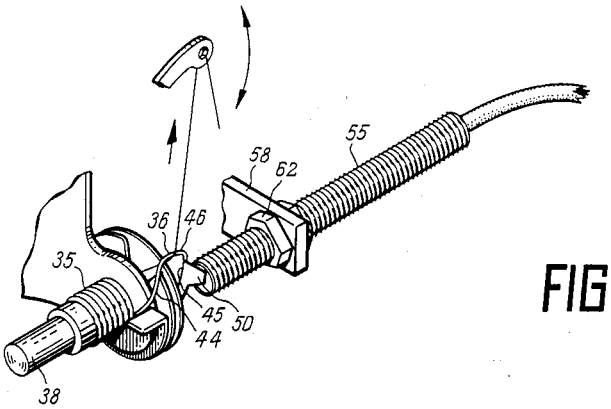
FIG. 3 is a perspective illustration of the proximity detector and check spring.

As illustrated in FIGS. 2 and 3, check spring 30 includes a coil portion 35 and a loop portion 36. The coil portion 35 is to be mounted on horizontal post 38, with the check spring tensioner 27 also mounted on the same post. The loop 36 of the check spring straddles the check spring tensioner, and the outer coil 39 of the check spring surrounds the outer end portion of post 38 which is longitudinally split and externally threaded to receive internally threaded nut 40 (FIG. 2).

As illustrated in detail in FIGS. 2 and 3, the looped portion 36 is approximately U-shaped, and includes inside and outside legs 44 and 45 joined together by intermediate leg 46. Stationary spring rest 48 extends from the check spring tensioner 27 toward the housing of the sewing machine, and inside leg 44 of the check spring 30 normally rests upon the spring rest. When the thread 20 is pulled back through the needle 15 by thread takeup arm 32 which reciprocates as indicated by double headed arrow 33, the thread becomes tight and is pulled toward a straight configuration between the thread tensioner 27 and takeup arm 32, which causes the thread to engage the intermediate leg 46 of the loop 36 of the check spring, pulling the loop against the bias of the coil portion 35 away from spring rest 48. When the takeup arm moves down, the tension in the thread is relaxed and the coil portion 35 moves the loop back to its position of rest against spring rest 48.

A flag 50 is attached to outside leg 45 of check spring loop 36. Flag 50 comprises a thin layer of sheet steel that is attached along one of its edge portions to outside leg 45 of the loop of the check spring 30. The flag 50 moves with the looped portion of the check spring.

A proximity detector 55 is positioned adjacent the path of movement of flag 50. As illustrated in FIG. 2, support post 56 extends laterally from support plate 19, and support bar 58 is fixedly attached to the support post by means of a screw 59 extending through an opening 60 of the support bar into an internally threaded bore 61 of the support post. The attitude of the support bar can be adjusted with respect to the support post and when screw 59 is tightened, the support bar 58 remains in a stationary position.

Proximity detector 55 is mounted within a cylindrical, externally threaded housing 61, the housing extends through an opening (not shown) in the support bar 58, and nuts 62 are threaded onto the external threads of the housing until they abut the support bar 58 and hold the proximity detector 55 rigidly with respect to the support bar.

Figure 4:
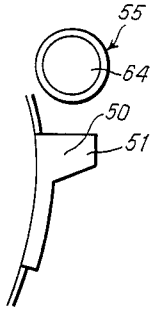
FIGS. 4 and 5 are detail views of the flag of the check spring, showing in FIG. 4 the position of the check spring when the thread is relaxed, and showing in FIG. 5 the position of the check spring when tension has been applied to the thread.
Figure 5:
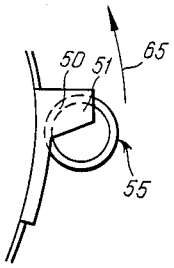

The end portion 64 of proximity detector 55 is positioned adjacent the path of movement of the flag 50 of check spring 30 (FIGS. 4 and 5), so that when the check spring is at rest with its inside leg 44 engaging spring rest 48 (FIG. 2), the protruding portion 51 of the flag 50 will be below the end 64 of the proximity detector 55. When tension is applied to thread 20 by takeup arm 32 moving in an upward direction, the thread 20 engages and pulls against the intermediate leg 46 of the loop 36 of the check spring, causing the check spring to move against the bias of its coil 35, so that the check spring moves away from spring rest 48. When the thread tension lifts the loop of the check spring away from its spring rest 48, the flag 50 moves as indicated by direction arrow 65 (FIG. 5), so that the protruding portion 51 of flag 50 moves into alignment with the end 64 of the proximity detector 55. When the tension in the thread disappears because of the downward movement of the takeup arm 32, the bias of the coil 35 of the check spring will move the flag 50 back to its rest position (FIG. 4), out of alignment with detector 55.

An electrical control circuit including a time-out circuit diagramatically shown in FIG. 2, is utilized which is activated by proximity detector 55. Such circuits are commonly available, with circuits being disclosed in the patents previously listed in this description. One commercially available circuit that is more suitable for use in connection with the proximity detector 55 is the MC 14541B programmable timer produced by Motorola. This circuit is desirable for use with the sewing machine because of its ability to rapidly reset itself upon each reciprocation of the check spring. The circuit is activated when the flag 50 registers with proximity detector 55 and the circuit begins to time out when the flag 50 moves away from proximity detector 55. If the flag 55 is not pulled by thread 20 back into registration with proximity detector 55 before the circuit times out, the circuit deactivates the sewing machine motor, thus stopping the sewing function. However, during normal high speed operation of the sewing machine the repeated tightening of the needle thread 20 pulls the flag 50 back into registration with the proximity detector 55 at a frequency high enough to avoid having the circuit time out. This avoids termination of the sewing operation.

Should the thread 20 become broken and the broken end portion remain free of the needle and the work product, the takeup arm 32 will not create much tension in the thread when the takeup arm moves in an upward direction. Therefore, the check spring and its flag 50 will not move in response to the upward movement of the takeup arm and the detector 55 will no longer receive the continuing signals from movement of the flag 50. The circuit responds to the constant signals from the detector 55 by deactuating the electric motor that runs the sewing machine. Of course, this terminates the operation of the sewing machine and terminates the movement of the work product through the sewing machine so that the thread can be brought back to the needle and then the sewing function can be resumed.

In the event that the thread breaks but is somehow caught in the work product or trapped between the presser foot and the work product so that the thread continues to move with the work product, the takeup arm 32 is likely to continue to apply cyclic tension to thread 20 which extends back through the check spring 30. However, there usually is a short time between thread breakage and continuing to pull the thread with the work product during which time there is slack in the thread. During this time the upward movement of the takeup arm 32 does not pull the thread tight enough to move the check spring flag 50 into registration with proximity detector 55. This permits the control circuit to time out and terminate operation of the sewing machine motor.

If the time between thread breakage and resuming movement of the thread with the work product is so short that the control circuit does not detect thread breakage and the broken needle thread continues to be pulled by the work product, it is possible that the amplitude of cyclic movement of the check spring and its flag 50 will be relatively short because the work product does not pull the broken thread as far as the needle pulls the thread on each cycle of the sewing machine. For example, the flag 50 tends to move at a relatively constant amplitude with respect to the end 64 of proximity detector 55 when the work product is of substantially uniform thickness. If the proximity detector 55 is positioned so as to detect differences in amplitude of movement of the flag, the control circuit can deactuate the sewing machine motor when incorrect amplitude is detected.

It will be noted that the proximity detector 55 can be adjusted with respect to the arc of movement of the flag 50. Thus, the ability of the system to detect longer or shorter strokes of the check spring can be changed, as might be desired by the system operator.

For example, when the sewing machine is to sew through a type of work product that has seams or other thicker portions that must pass beneath the needle, the amount of thread required for the deeper stitches formed through the thicker portions of the work product is more than the amount of thread required for the normal stitches, and the amplitude of check spring movement might increase during the formation of the deeper stitches even though the frequency of the check spring movement would stay the same. The placement of the proximity detector 55 adjacent the path of movement of the check spring, not in the path, permits the check spring loop 36 and flag 50 to move without obstruction during the large amplitude movements slightly beyond the proximity detector 55, while the control circuit continues to monitor the system without interrupting the operation of the sewing machine motor. However, should the amplitude of check spring movement decrease, as when the thread has broken but continues to be pulled by the work product, the check spring flag might not register with the proximity detector during short amplitude movement, causing the control circuit to terminate operation of the sewing machine motor.

Figure 6:
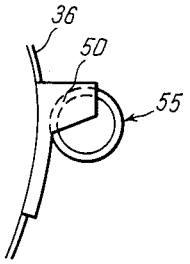
FIGS. 6 and 7 are similar to FIGS. 4 and 5 but show the proximity detector repositioned adjacent the position of rest of the check spring.
Figure 7:
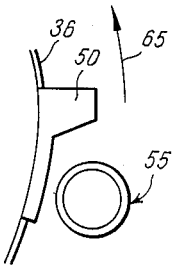

While the proximity detector 55 has been described as positioned to detect the check spring flag 50 when the tension of the thread 20 pulls the loop 36 of the spring away from its position of rest, FIGS. 6 and 7 show the detector 55 located adjacent the position of rest, so that flag 50 registers with the proximity detector when the thread is relaxed and the check spring loop 36 is at its position of rest. When tension is applied to the thread the check spring and flag are pulled out of registration with detector 55 (FIG. 7). Thus, the cyclic movement of the check spring can be detected at either end of the arcuate reciprocations of the check spring loop 36 and its flag 50.

It will be understood that the foregoing relates only to a preferred embodiment of the present invention, and that numerous changes and modifications may be made therein without departing from the spirit and scope of the invention as set forth in the following claims.

I claim:

1. A sewing machine of the type that includes a needle that carries a thread into a work product being advanced beneath the needle and with the thread being threaded in series through a takeup arm which pulls the thread tight back through the needle when the stitch has been formed and through a check spring which moves from a position of rest in response to the thread becoming tight on each stitch cycle of the sewing machine, the improvement therein of apparatus for controlling the operation of said sewing machine including a proximity detector for determining if the check spring moves away from its position of rest and changes its distance from said proximity detector in response to the thread becoming tight during each cycle of said sewing machine, control means responsive to the determination of the lack of proper movement of said check spring away from its position of rest during the cycles of operation of said sewing machine for terminating the operation of said sewing machine, and the proximity detector located out of the path of movement of said check spring so that there is no contact therebetween, said proximity detector mounted on an adjustable support means for location in variable selected positions along said path of movement.

2. The sewing machine of claim 1 and further including a flag member affixed to said check spring whereby the flag member normally reciprocates between predetermined positions each time the thread of the sewing machine tightens, and wherein the proximity detector is located adjacent one of said predetermined positions of said flag member and determines the presence and absence of the flag member at said predetermined position.

3. The sewing machine of claim 1 and wherein said check spring comprises a coil torsion spring extending about a fixed support and a loop formed at one end for receiving therethrough the thread moving to the needle of the sewing machine, said loop being arranged to yield in response to tension being applied to the thread, and further including a flag member affixed to the loop of said spring which moves in unison with said loop, said proximity detector being arranged to determine the movement of said flag member.

4. The sewing machine of claim 1 and wherein said check spring comprises a coil portion and a loop extending from the coil portion that is movable in an arcuate path about the coil portion toward and away from a predetermined position whereby tension in the thread moves the loop of the check spring away from the predetermined position along the arcuate path, and wherein said proximity detector is positioned adjacent the predetermined position so as to detect the loop of the check spring as the loop moves toward its predetermined position.

5. A method of detecting improper thread use in a sewing machine of the type that includes a needle that carries a thread into a work product being advanced beneath the needle and with the thread being threaded in series through a takeup arm which pulls the thread tight back through the needle when the stitch has been formed and through a check spring which moves in response to the thread becoming tight on each cycle of the sewing machine, comprising the steps of:

observing the frequency of cyclic motion of the check spring with a proximatiy sensor, by determining the elapsed time between passes over the proximity sensor of a flag attached to the check spring, and stopping the operation of the sewing machine in response to the observed frequency of the check spring not being as high as a predetermined frequency.

6. The method of claim 5 and wherein the step of stopping the operation of the sewing machine comprises initiating a time-out circuit each time the proximity sensor detects the check spring, the time-out circuit having a duration longer than the expected duration between cycles of motion of the check spring, whereby the time-out circuit will expire in response to the check spring moving too slow.

7. In a sewing machine for stitching a work product, the improvement comprising a check spring including a coil torsion portion and a loop portion extending outwardly from said coil portion and arranged to move in an arcuate path about said coil portion during a stitch cycle of the sewing machine in the tightening of a needle thread, and a metallic flag affixed to said loop portion for movement with the loop portion in said arcuate path, and a proximity detector located out of the arcuate path of movement of the loop portion of said check spring so that there is no contact therebetween for detecting the movement of the metallic flag in the arcuate path as the metallic flag moves adjacent the proximity detector, said proximity detector mounted on an adjustable support means to be variably located in selected positions along said path of movement.

8. A method of detecting thread movement through a check spring toward the needle of a sewing machine for stitching a work product as the check spring moves in response to tension in a needle thread applied by a takeup arm of the sewing machine, comprising detecting the movement of the check spring away from its position of rest with a adjustably mounted proximity sensor located in a selected position out of the path of movement of the check spring as the check spring moves adjacent the proximity sensor so that there is no contact therebetween, whereby the position of the proximity sensor can be selected as a function of the type of work product being stitched.

9. The method of claim 8 and wherein the step of detecting the movement of the check spring comprises detecting the movement of a flag affixed to the check spring with the proximity sensor located out of the path of movement of the flag adjacent a predetermined position of said flag.

10. A sewing machine of the type that includes a needle that carries a thread into a work product being advanced beneath the needle and with the thread being threaded in series through a takeup arm which pulls the thread tight back through the needle when the stitch has been formed and through a check spring which includes a coil portion and a loop extending from the coil portion that is moved by the thread in an arcuate path about the coil portion toward and away from a position of rest in response to the thread becoming tight on each cycle of the sewing machine, the improvement therein of apparatus for controlling the operation of said sewing machine including a proximity detector juxtaposed the path of movement of said check spring and positioned away from the position of rest of the check spring for detecting the presence of the check spring in close spaced relationship with respect to said proximity detector as the check spring moves in front of the proximity detector in response to the thread becoming tight during each cycle of said sewing machine, and control means responsive to the detection by the proximity detector of the lack of proper movement of said check spring away from its position of rest during the cycles of operation of said sewing machine for terminating the operation of said sewing machine.

11. The sewing machine of claim 10 and further including a flag member affixed to said check spring whereby the flag member normally reciprocates between predetermined positions each time the thread of the sewing machine tightens and the proximity detector determines the presence and absence of the flag member at one of the predetermined positions.

* * * * *